US008801459B2

(12) United States Patent
Mrowka

(10) Patent No.: US 8,801,459 B2
(45) Date of Patent: Aug. 12, 2014

(54) CIRCUIT BOARD COAXIAL CONNECTOR

(75) Inventor: Eckhard Mrowka, Herisau (CH)

(73) Assignee: Huber+Suhner AG, Herisau (CH)

( * ) Notice: Subject to any disclaimer, the term of this patent is extended or adjusted under 35 U.S.C. 154(b) by 0 days.

(21) Appl. No.: 13/575,262

(22) PCT Filed: Jan. 25, 2010

(86) PCT No.: PCT/EP2010/050809
§ 371 (c)(1),
(2), (4) Date: Jul. 25, 2012

(87) PCT Pub. No.: WO2011/088902
PCT Pub. Date: Jul. 28, 2011

(65) Prior Publication Data

US 2012/0295478 A1 Nov. 22, 2012

(51) Int. Cl.
*H01R 9/05* (2006.01)

(52) U.S. Cl.
USPC ..... 439/578; 439/63; 439/246; 439/581

(58) Field of Classification Search
USPC ..... 439/246, 578, 63, 8, 65
See application file for complete search history.

(56) References Cited

U.S. PATENT DOCUMENTS

| | | | | |
|---|---|---|---|---|
| 4,925,403 | A | 5/1990 | Zorzy | |
| 5,879,177 | A | 3/1999 | Honma | |
| 6,497,579 | B1 * | 12/2002 | Garbini | 439/63 |
| 2004/0038586 | A1 | 2/2004 | Hall et al. | |
| 2006/0194465 | A1 | 8/2006 | Czikora | |
| 2007/0026698 | A1 | 2/2007 | Rosenberger | |
| 2009/0149086 | A1 | 6/2009 | Dahms | |

FOREIGN PATENT DOCUMENTS

| | | |
|---|---|---|
| CN | 2879475 | 3/2007 |
| CN | 101459304 | 6/2009 |
| EP | 0 793 299 A1 | 9/1997 |
| EP | 1 207 592 A2 | 5/2002 |
| TW | M391221 U1 | 10/1999 |
| WO | WO 0052788 A1 | 9/2000 |

* cited by examiner

*Primary Examiner* — Briggitte R Hammond
(74) *Attorney, Agent, or Firm* — Pauley Petersen & Erickson

(57) ABSTRACT

The invention relates to a coaxial connector (1), comprising a first and a second connector part (2, 3) and an adapter (4) arranged therebetween. The first and the second connector part (2, 3) include a first inner conductor (5) and a first outer conductor (8), including a first internal cylindrical contact surface (24) and a second internal cylindrical contact surface (25), respectively. In a socket area (17) of the first inner conductor (5), a first mechanical operative-connection means interacts with a second mechanical operative-connection means (11) in the installed state in order to establish a mechanical connection (13) that is effective in the axial direction (z). The first inner conductor (5) protrudes beyond the level of the mechanical operative-connection means (10, 11) so the internal cylindrical contact surface (24) is able to compensate a large axial offset (dz) of the connector parts (2, 3) relative to the adapter (4).

10 Claims, 4 Drawing Sheets

CIRCUIT BOARD COAXIAL CONNECTOR

BACKGROUND OF THE INVENTION

1. Field of the Invention

The present invention is in the field of coaxial connectors for circuit boards.

After the mounting of SMD devices on circuit boards and subsequent soldering, circuit boards are contact-connected to one another from a radiofrequency standpoint. In this case, it is necessary to compensate for location and positional inaccuracies of the SMDs (Surface Mounted Devices) in a radial and axial direction, in order that the radiofrequency properties are maintained. In general, it is necessary to connect a plurality of connectors simultaneously.

2. Discussion of Related Art

Various circuit board coaxial connectors are known from the prior art. Said connectors have a multipartite construction comprising a first and a second connector part, which are operatively connected to each other by means of an adapter piece. There are problems in respect of the fact that said connectors usually have a complicated construction and/or permit only insufficient movement play.

U.S. Pat. No. 4,925,403 was published in 1988 and discloses a coaxial connector of the type described comprising an adapter piece. The connector is constructed such that it can compensate for a certain lateral offset. A mechanical snap-action connection is produced by means of an outer conductor of the adapter piece.

U.S. Pat. No. 5,879,177 discloses a further connector comprising a first and a second connector part, which can be operatively connected by an adapter piece. The adapter piece serves to compensate for a certain lateral offset.

WO0052788A1 from the same applicant was published in 2000 and discloses an improved connector of the generic type. The connector has a first and a second connector part, which can be operatively connected by means of an adapter piece. In order to reduce forces that arise, a ball-and-socket joint is used at least on one side.

EP1207592 was published in 2002 and relates to a coaxial plug arrangement comprising a first and a second coaxial plug connector and a contact sleeve connecting them. The contact sleeve is designed such that it is laterally tiltable in a predetermined region. The first coaxial plug connector and the contact sleeve have a latching connection in the region of their outer conductor. The latching connection in the region of the outer conductors has a restrictive effect on the freedom of movement. All first coaxial plug connectors are arranged in a common first plastic housing and all second coaxial plug connectors are arranged in a common second plastic housing.

Further connectors with one of the generic type are known from US2004038586, US2007026698 A, US2006194465A, CN2879475Y, and CN101459304A.

SUMMARY OF THE INVENTION

One object of the invention is to disclose an improved connector of the generic type. A further object is to disclose a connector having an extended functional region.

This object is achieved by means of the connector defined in the independent claims.

A circuit board coaxial connector (hereinafter coaxial connector) according to the invention has a multipartite construction comprising a first and a second coaxial connector part, which can be operatively connected to each other by means of an adapter piece having a coaxial construction. The adapter piece has a first and a second end having an inner and an outer conductor, respectively which can be operatively connected to corresponding inner and outer conductors, respectively, of the connector parts. At least one connector side has mechanical operative-connection means which connects the corresponding connector part and the assigned end of the adapter "fixedly" to each other, that is to say that under normal circumstances the connection is no longer releasable at all or releasable by application of an elevated force. In contrast thereto, the operative connection of the other connector part to the adapter can be released at a lower force level. The operative-connection means are arranged relative to the conductors such that a largest possible offset is possible in an axial and lateral direction. By way of example, in one embodiment, given a distance of 13 mm, the connector can enable an offset of ±1.2 mm whilst maintaining a predetermined radial capture range. In particular, in order to compensate for axial displacements, in one embodiment the connector parts can extend telescopically from one another. For this purpose, at least one of the connector parts or of the adapter has a sleeve-shaped inner conductor, into which, from the corresponding counterpiece, a ball-like element dips and is arranged such that it is displaceable in an axial direction. In order that a largest possible axial and lateral displacement is possible, the sleeve-shaped conductor projects beyond the operative-connection means in an axial direction.

The inner and outer conductors of the adapter piece are positioned opposite one another by means of a spacer. The spacer can have a multipartite construction in an axial direction, such that the adapter piece is scalable in a simple manner in terms of its length, for example, without the spacer having to be adapted in a complex manner. One advantage is that the same spacers can always be used. A further advantage is that the spacers can have different colors, so that the correct assembly of the very small parts can be monitored optically in a simple manner.

In one embodiment, the first and second connector parts are embodied in identical fashion. The production costs can thus be reduced. In order nevertheless to provide the optimum capture range during connecting, the connector parts are designed such that a capture funnel can be fixed to them. Said capture funnel can be fixed e.g. by pressing, adhesive bonding, friction welding, etc. The capture funnel is normally fixed on a releasable connector side and serves for capturing the counterpiece. One advantage is that the capture funnel can be adapted according to the requirements. The capture funnel can be produced from a cheaper material, as necessary. Furthermore, there is the possibility of combining a plurality of capture funnels in one device. Depending on the field of application, the capture funnel can also be used for other connectors.

In the prior art, the radial capture range defined by the funnel generally has to be adapted by enlarging the funnel if the circuit board distance becomes larger, in order that the longer adapter, which thus pivots out further, can be guided into the counterpiece during connecting. This is generally undesirable for space reasons. In one embodiment, the maximum possible lateral inclination is limited by mechanical means depending on the connector distance. By means of the configuration and articulation geometry according to the invention, the axial tolerance range for the circuit board distance is increased. Said range is normally ±0.3 mm. In contrast thereto, a connector according to the invention enables a tolerance range of the order of magnitude of ±1.2 mm.

In the case of the connectors known from the prior art, the radial capture range (funnel) generally has to be enlarged if the circuit board distance becomes larger, in order that the longer adapter, which thus pivots out further, can be guided into the counterpiece. This is generally undesirable for space reasons. As explained, the maximum inclination of the snapped-in adapter can be limited depending on the desired distance between the two circuit boards with a predetermined radial capture range, by means of the diameters of the adapter and of the connector parts being coordinated with one another depending on the angle sought.

One embodiment relates to a coaxial connector comprising a first and a second connector part and an adapter arranged therebetween. The first and the second connector parts have a first inner conductor and a first outer conductor, which are operatively connected fixedly to each other by means of a first spacer. The first inner conductor has a first internal cylindrical contact surface and the first outer conductor has a second internal cylindrical contact surface. The adapter has a second inner conductor and a second outer conductor which are operatively connected by means of a second spacer. The second inner conductor and the second outer conductor have at their ends elastic spring tongues with radially projecting contact beads, which in the assembled state electrically conductively interact with the internal cylindrical contact surfaces of the first and second inner conductors of the first and second connector parts. The elastic spring tongues together with the contact beads serve for producing and maintaining a secure electrical connection. First mechanical operative-connection means are arranged in a rear, non-free region (base region) of the first inner conductor, and in the assembled state interact with second mechanical operative-connection means of the adapter in order to form a mechanical connection that is effective in an axial direction. The mechanical operative-connection means can be a ball and a socket, or a groove and a projecting holding bead, which interact in a positively locking manner in the assembled state. A sleeve-shaped part of the first inner conductor projects beyond the mechanical operative-connection means at least on the side of the mechanical connection in an axial direction in such a way that an axial offset of the connector parts relative to the adapter is compensated for by a telescopic displacement of at least one connector part relative to the adapter.

The first mechanical operative-connection means can be a radially outwardly projecting holding bead on the first spacer and the second mechanical operative-connection means can be a circumferential groove arranged on an inner surface of the second spacer, which can be operatively connected e.g. by snap action. The second inner conductor of the adapter can have a cross-sectional constriction in a region behind the first spring tongues, said constriction enabling an enlarged tilting angle $\alpha$ in a lateral direction.

In one preferred embodiment, the second spacer of the adapter has a multipartite construction in an axial direction. The multipartite construction enables a simple scaling of the length whilst maintaining the same spacers. By using different materials, it is possible to indicate visually whether the connector has been correctly assembled. The second spacer can consists of a first and a second part which are produced from different materials. On the side of the releasable connector part, a comparatively soft material is normally used, for example, which is a more deformable. On the side of the releasable connector part, a material having a better thermal conductivity is advantageously used. Given suitable configuration, the spacer can also be used for other connectors having a similar construction.

BRIEF DESCRIPTION OF THE DRAWINGS

The invention is explained in greater detail below with reference to figures, which merely illustrate exemplary embodiments. In the figures

Unless mentioned otherwise, the same reference signs are used for mutually corresponding regions parts in the figures.

DESCRIPTION OF PREFERRED EMBODIMENTS

Figure 1:
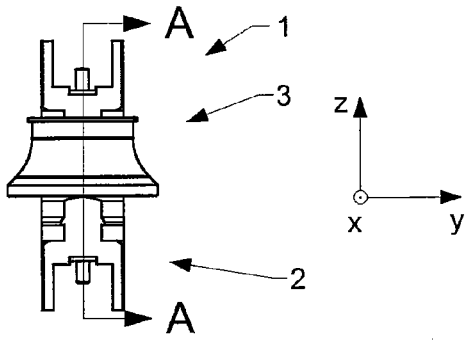
FIG. 1 shows a connector according to the invention in a front view in the assembled state.

FIG. 1 shows a coaxial connector 1 according to the invention comprising a first connector part 2, a second connector part 3 and an adapter 4, which serves for operatively connecting the first to the second connector part 2, 3. The connector parts 2, 3 and also the adapter 4 have a coaxial construction.

Figure 2:
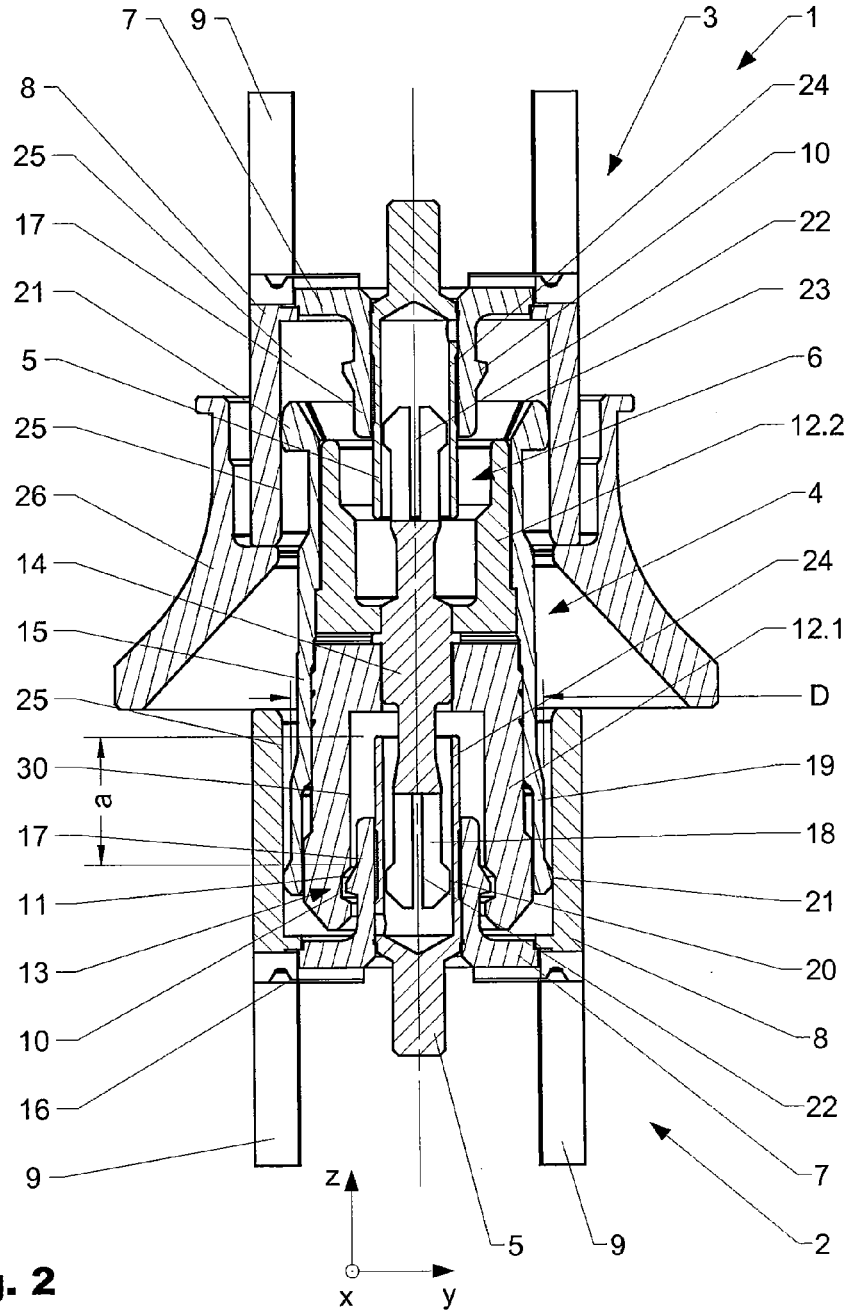
FIG. 2 shows a sectional illustration through the connector in accordance with FIG. 1.
Figure 3:
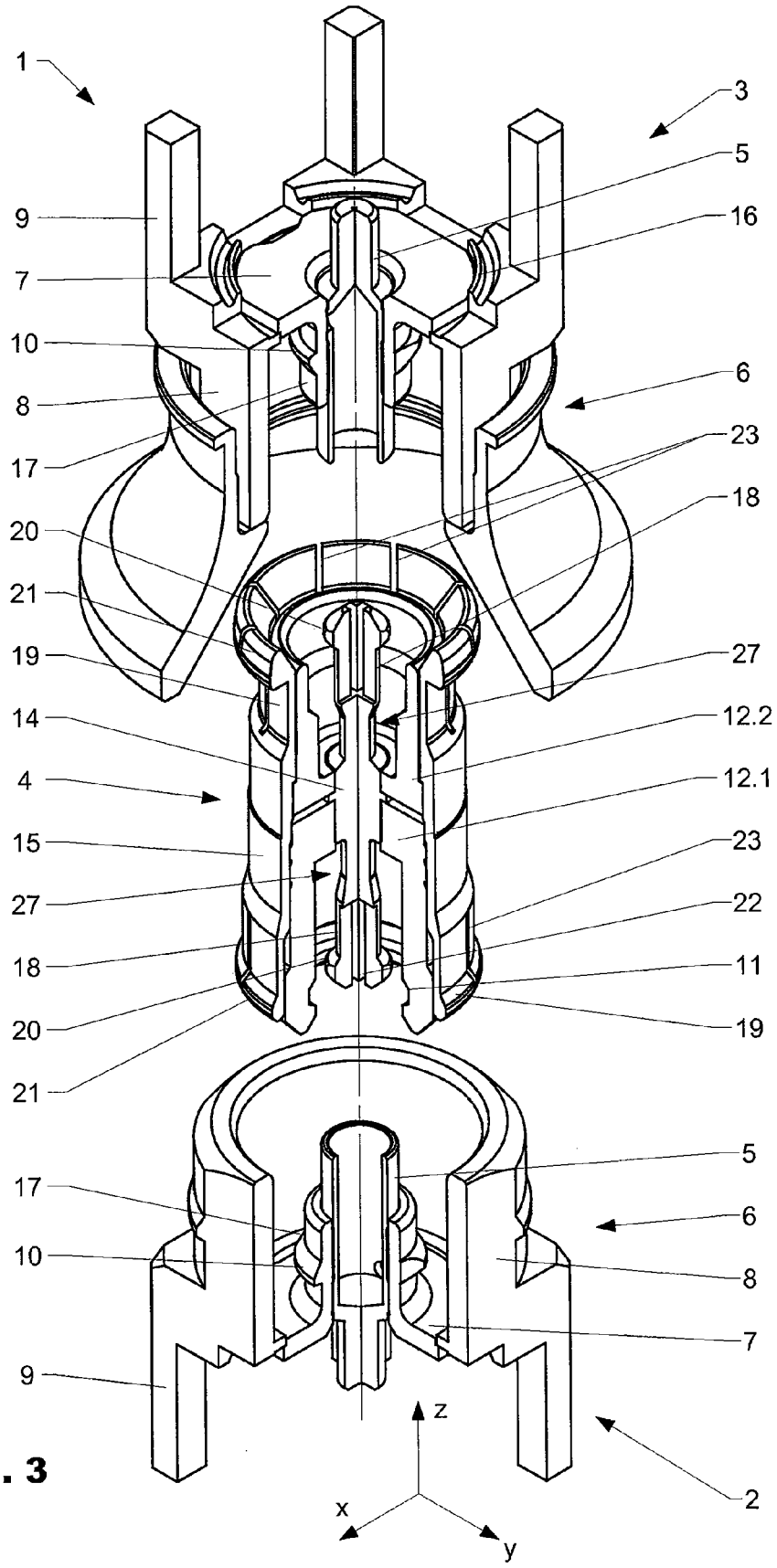
FIG. 3 shows a perspective sectional illustration of the connector in accordance with FIG. 1 in a non-operatively connected state.

FIG. 1 shows the coaxial connector 1 in the operatively connected state in a front view. FIG. 2 shows a sectional illustration through the connector 1 along the sectional line AA in accordance with FIG. 1. FIG. 3 shows the connector parts 2, 3 and the adaptor 4 in a perspective view obliquely from above. The connector parts 2, 3, 4 are arranged one above another, but not operatively connected. In order to afford a better understanding, the connector parts 2, 3, 4 are illustrated sectionally, such that the internals can be discerned.

In the embodiment shown, the first and second connector parts 2, 3 have an identical construction. There is the possibility, as necessary, for the first and second connector parts 2, 3 not to be configured in identical fashion, in compliance with the requirements. Furthermore, in contrast to the prior art, the parts 2, 3, 4 have a comparatively simple construction which can be assembled with little outlay. This has a positive effect on the production costs.

The first and second connector parts 2, 3 each have a cylindrical inner conductor 5, which is in each case configured in sleeve-shaped fashion at its front end 6. As can be discerned in FIG. 2, the inner conductor 5 is positioned and held opposite an outer conductor 8, which is sleeve-shaped at its front end, by a first spacer 7, which here is rotationally symmetrical. The outer conductor 8 is configured in cylindrical fashion at least in the front region and is arranged coaxially opposite the inner conductor 5. In the embodiment shown, both the first spacer 7 and the inner conductor 5 are arranged inside the sleeve-shaped part of the outer conductor 8. In the rear region, in the embodiment shown, the outer conductor has fixing means in the form of mounting bases 9, by means of which the connector part 2, 3 can be fixed e.g. on a circuit board (not illustrated in specific detail). Other configurations are possible. By means of a deformable crimp edge 16, the first spacer 7 can be fixed in the housing of the first outer conductor 8. Other types of fixing are possible. The first inner conductor 5 is fixed in the first spacer 7 by press-fitting. Other types of fixing are possible here, too.

As can be discerned in FIG. 2, the first spacer 7 extends along the first inner conductor 5 and forms a substantially cylindrical base region 17, which bears here on the inner conductor 5 and on which an outwardly projecting, ring-shaped holding bead 10 (first operative-connection means) is formed. The holding bead 10 is formed at the rear, non-free end of the base region. As illustrated, the latter engages, in the assembled state, into a ring-shaped groove 11 (second operative-connection means) of a second spacer 12.1 of the adapter 4 and forms therewith an articulated mechanical connection 13. The mechanical connection is generally configured as a releasable snap-action connection and enables the adapter 4 to be separated from the first connector part 2 by the application of a certain force in the axial direction. The mechanical connection 13 has a certain play enabling the adapter 4 to be tilted relative to the first connector part 3 in a lateral direction by a certain angle α (in this respect, cf. FIG. 5). Depending on the field of application, a different configuration of the operative-connection means 20, 21 is possible. By way of example, one of the holding means can also be configured as a depression in the outer conductor, a projecting bead of the outer conductor of the adapter snapping into said depression. However, the range of movement is smaller in the case of such an embodiment.

A capture funnel 26 is fixed onto the second connector part 3 in the embodiment shown, said funnel facilitating assembly. Particularly in the case of oblique adaptors 4 or if a lateral offset occurs during assembly, the capture funnel 26 serves as an assembly aid by virtue of the fact that it guides the free end of the adapter 4 securely into the opening provided therefor in the inner conductor 8.

As can be discerned in FIGS. 2, 3, 5 and 7, in the embodiment shown, the second spacer 12.1, 12.2 of the adapter 4 is embodied in bipartite fashion and has a first and a second part 12 (12.1, 12.2). The second spacer 12 positions a second inner conductor 14 opposite a second outer conductor 15 of the adapter 4. Both the inner and the outer conductors 14, 15 have first and second spring tongues 18, 19, which have at their ends first and second contact beads 20, 21, which, in the embodiment shown, are embodied in circumferentially projecting fashion. In order to keep the forces low, the outer surfaces of the contact beads 20, 21 are advantageously configured in ball-like fashion. The spring tongues 18, 19 are functionally separated from one another by slots 22, 23 and can spring in a radial direction. The slots are arranged either radially or in pairs in a parallel manner (cf. FIG. 3). In the connected state (cf. FIGS. 2 and 3), the contact beads 20, 21 form an operative connection to internal first and second contact surfaces 24, 25 of the inner conductors 5 and of the outer conductors 8. The contact surfaces 24, 25 are coordinated with one another in terms of their length, such that the adapter 4 can be telescopically displaced, or extended, relative to the second connector part 3 in an axial direction (the z-axis). For this purpose, the inner conductor 5 projects beyond the operative-connection means 10, 11 by a distance a in an axial direction. The distance a corresponds, in terms of order of magnitude, to the displacement to be compensated for in an axial direction. In the embodiment shown, the active length L2 of the outer conductor 8 (cf. FIG. 5) is greater than the active length L1 of the inner conductor 5. What is thereby achieved is that, during connecting, firstly the outer conductor 8 and only afterward the inner conductor 5 is operatively connected.

In the embodiment illustrated, the first and second contact beads 20, 21 are arranged substantially at the same height in an axial direction. Depending on the embodiment, the contact beads 20, 21 can also be arranged at different heights. In this case, there is the possibility of generating, as necessary, a certain restoring force that prevents undesired tilting, or inclination, of the adapter with respect to the first connector part 2. This can be advantageous particularly during assembly.

Figure 4:
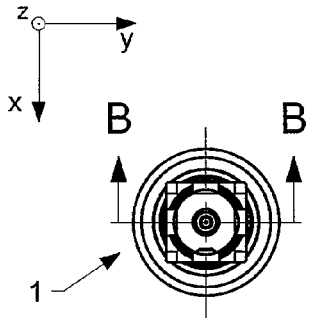
FIG. 4 shows the connector in a plan view in a deflected state.
Figure 5:
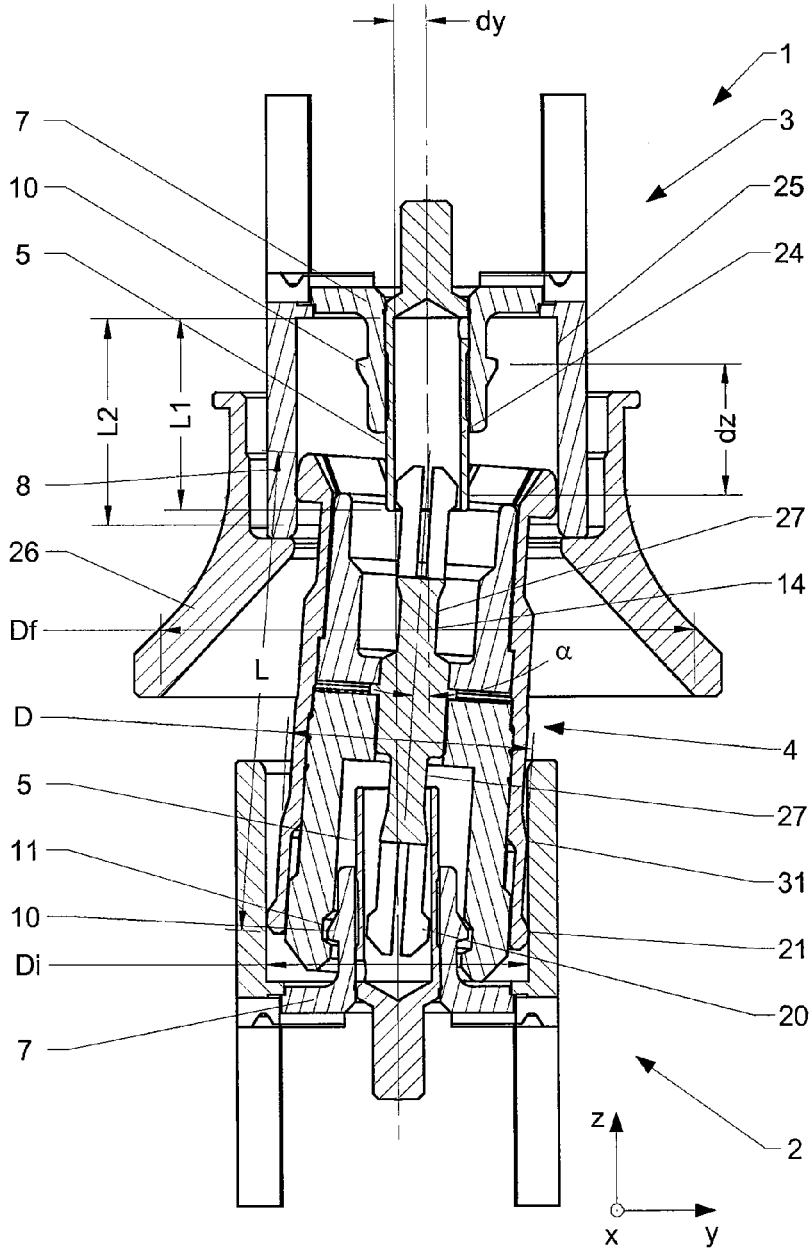
FIG. 5 shows a section through FIG. 4 along the sectional line BB.

FIG. 4 shows the connector 1 in accordance with FIGS. 1 to 3 in a plan view, and FIG. 5 shows a sectional illustration through the connector along the sectional line BB in accordance with FIG. 4. FIG. 5 illustrates the connector 1 in a deflected state. The first and second connector parts 2, 3 are arranged in a manner laterally (y-direction) offset with respect to one another. The axial offset is indicated by dy. At the same time, the second connector part is displaced relative to the first connector part in an axial direction (indicated schematically by dz). In contrast to the prior art, in the embodiment shown, the cylindrical contact surfaces 24, 25 of the outer conductors 5, 8 are made significantly longer in order that the connector part 3 can extend comparatively far relative to the adaptor 4 in an axial direction. By virtue of this telescopic configuration, the connector 1 can be used significantly more widely than the connectors known from the prior art. As can be discerned, the first contact bead 20 is extended beyond the first operative-connection means 10 by dz as seen in an axial direction inside the first inner conductor 5.

In the embodiment shown, a capture funnel 26 is fitted on the second connector part 3, and, during connecting, simplifies the movement of the free end of the adapter 4 into the second connector part 26. In the embodiment shown, the capture funnel 26 is pressed on, but can also be fixed in some other way. The capture funnel can be produced from metal or plastic or some other suitable material.

As can be discerned in FIG. 5, the second inner conductor 14 of the adapter 4 has cross-sectional constrictions 27 in the region behind the second spring tongues 19, the first outer conductor of the first connector part 2 being able to dip into said constrictions if the adapter 4 is tilted by the angle α relative to the first or the second connector part 2, 3, respectively, in the inserted state. By means of cross-sectional constrictions 27, the possible lateral offset range is increased by comparison with the conventional connectors. Depending on the embodiment, the cross-sectional constriction may also be required only on one side. In the embodiment shown, the maximum possible tilting angle α is limited by a diameter D of a shoulder 31 of the adapter 4, or of the outer conductor 15, respectively, which makes contact with the inner surface (second contact surface) 25 in the maximally deflected state. By increasing or respectively decreasing the diameter D, it is possible to set the tilting angle α to a diameter Df of the capture funnel 26 in a manner dependent on the length L of the adapter 4 and an internal diameter Di of the second contact surface 25. Instead of changing the diameter D, it is also possible to use spacer sleeves placed onto the adapter 4 or the first connector part 2. The described function of the cross-sectional constriction, or respectively the spacer sleeve, can also be used for other connectors having a similar construction (first and second connector parts which are operatively connected to each other by means of an adapter), in order to limit their relative lateral deflection (maximum tilting angle) and thus to determine the capture range.

Figure 6:
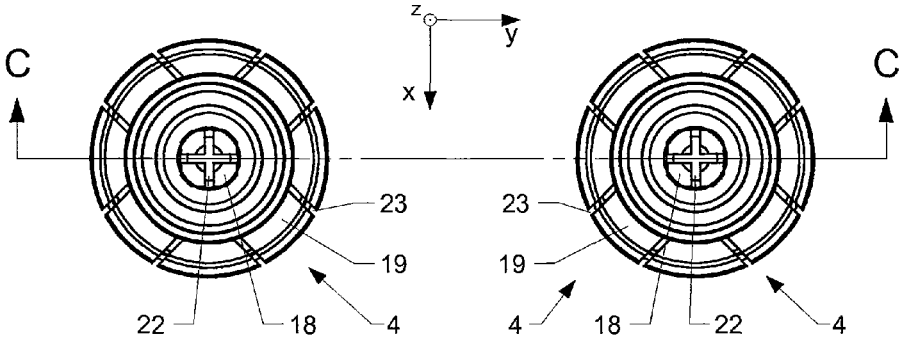
FIG. 6 shows two adapters in a plan view.
Figure 7:
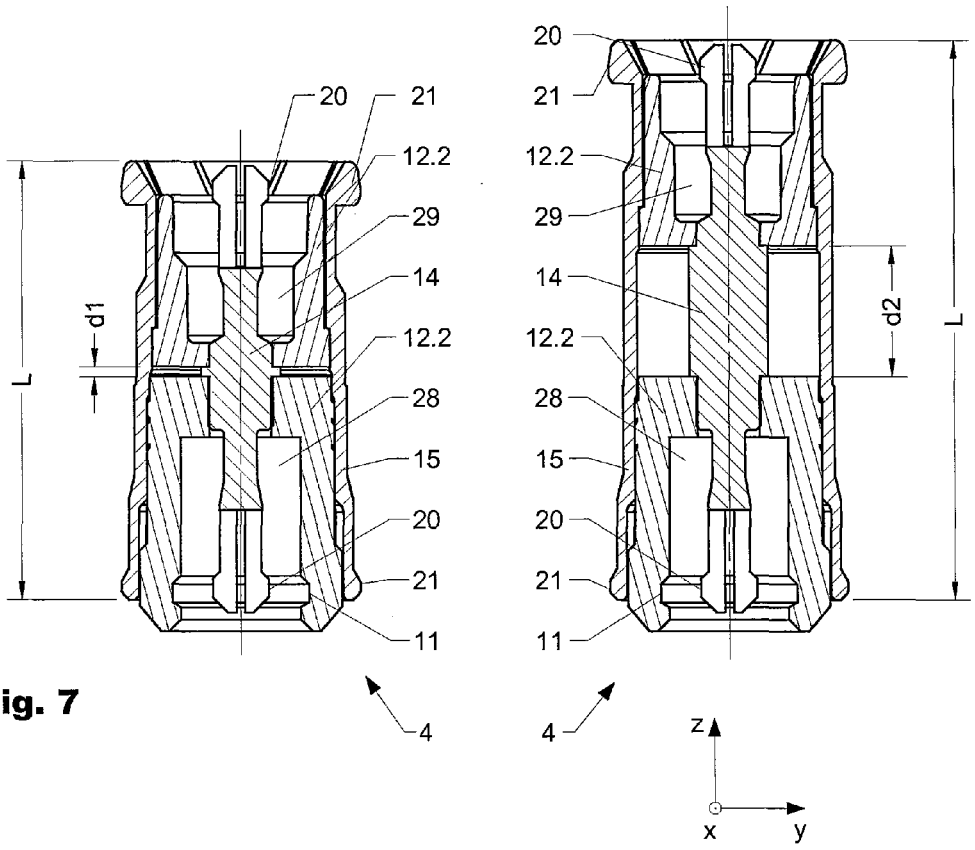
FIG. 7 shows the adapters in accordance with FIG. 6 in a sectional illustration along the sectional line CC.

FIGS. 6*a* and 6*b* illustrate two adapters 4 alongside one another in a plan view. FIGS. 7*a* and 7*b* illustrate the adapters 4 in a sectional illustration along the sectional line CC. The second spacer 12 is configured in bipartite fashion and consists of a lower spacer 12.1 and an upper spacer 12.2 from the point of view of the consideration. The advantage is that the adapter piece 4 can be adapted in a simple manner in terms of its length L3, L4 (cf. FIG. 7), by means of modifying solely the inner and outer conductors 14, 15 in terms of their length L3, L4. The lower and upper spacers 12.1, 12.2 can be taken over without being changed. This reduces the production costs. A further advantage is that the lower and upper spacers 12.1, 12.2 can have different colors. This affords the advantage that the lower end with the second operative-connection means 11 (fixed end) can be identified by a different color than the upper end (releasable end), which does not have said means.

In the embodiment shown, both the lower and the upper spacer 12.1, 12.2 have a depression 28, 29 running along the inner conductor 15, said depression being embodied such that it can accommodate the length of the inner conductors 5 projecting beyond the axial level of the operative connection 10, 11 in the inserted state.

The invention claimed is:

1. A coaxial connector (1) comprising:

a. a first and a second connector part (2, 3) and an adapter (4) arranged therebetween, wherein b. the first and the second connector parts (2, 3) including a first inner conductor (5) and a first outer conductor (8), which are operatively connected to each other by means of a first spacer (7), wherein the first inner conductor (5) includes a first internal cylindrical contact surface (24) and the first outer conductor has a second internal cylindrical contact surface (25), c. wherein the adapter (4) includes a second inner conductor (14) and a second outer conductor (15), which are operatively connected by means of a second spacer (12, 12.1, 12.2), wherein the second inner conductor (14) and the second outer conductor (15) include at their ends elastic spring tongues (18, 19) with radially projecting contact beads (20, 21), which in the assembled state electrically conductively interact with the internal cylindrical contact surfaces (24, 25) of the first inner conductor (5) and the first outer conductor (8) of the first and second connector parts (2,3);

d. wherein first mechanical operative-connection means (10) are arranged in a base region (17) of the first inner conductor (5), and in the assembled state interact with second mechanical operative-connection means (11) of the adapter (4) in order to form a mechanical connection (13) that is effective in an axial direction (z);

e. wherein the first inner conductor (5) projects beyond a level of the first mechanical operative-connection means (10) an axial direction (z) such that the active region of the internal cylindrical contact surface (24) compensates for a large axial offset (dz) of the connector parts (2, 3) relative to the adapter (4).

2. The coaxial connector (1) as claimed in claim 1, wherein the first mechanical operative-connection means comprises a radially outwardly projecting holding bead (10) on the first spacer and the second mechanical operative-connection means (11) comprises a circumferential groove (11) arranged on an inner surface (30) of the second spacer (12).

3. The coaxial connector (1) as claimed in claim 1, wherein the second inner conductor (15) of the adapter (4) includes a cross-sectional constriction (27) in a region behind the first spring tongues (18), said constriction enabling an enlarged tilting angle $\alpha$.

4. The coaxial connector (1) as claimed in claim I wherein the second spacer (12) of the adapter includes a multipartite construction (12.1, 12.2) in an axial direction.

5. The coaxial connector (1) as claimed in claim 4, wherein the second spacer (12) includes a first and a second part (12.1, 12.2), which are produced from different materials.

6. The coaxial connector (1) as claimed in claim 4, wherein the second spacer (12) includes a. first and a second part (12.1, 12.2), which have different colors in such a way that the plugging direction is indicated.

7. The coaxial connector (1)as claimed in claim 1, wherein one of the connector parts (2, 3) is suitable for accommodating a capture tunnel (26).

8. The coaxial connector(1) as claimer in claim 1, wherein the connector parts (2, 3) are configured in identical fashion.

9. The coaxial connector (1) as claimed in claim 1 wherein an internal diameter (Di) of at least one connector part (2, 3) and an external diameter (D) of the adapter (4) serve for determining a maximum tilting angle ($\alpha$).

10. The coaxial connector (1) as claimed in claim 1, wherein the first mechanical operative-connection means comprises a circumferential depression in the outer conductor and the second mechanical operative-connection means of the adapter comprises a radially inwardly projecting holding bead being able to snap into the circumferential depression.

* * * * *